United States Patent [19]

Garwood

[11] Patent Number: 4,932,818

[45] Date of Patent: Jun. 12, 1990

[54] ANCHOR BOLT POSITIONING SYSTEM FOR CONCRETE FOUNDATIONS

[76] Inventor: Bradley S. Garwood, 109 Monroe Blvd., Terre Haute, Ind. 47803

[21] Appl. No.: 377,332

[22] Filed: Jul. 10, 1989

[51] Int. Cl.[5] ..... F16B 35/00; F16B 37/14

[52] U.S. Cl. ..... 411/366; 411/397; 411/429; 52/704

[58] Field of Search ..... 411/82, 301, 15, 377, 411/366, 429, 431, 907, 908, 182, 512, 397; 52/704; 138/96 R, 96 T

[56] References Cited

U.S. PATENT DOCUMENTS

| | | | |
|---|---|---|---|
| 2,873,765 | 2/1959 | Gregory | 138/96 T |
| 2,930,409 | 3/1960 | Higgins | 138/96 T |
| 3,500,607 | 3/1970 | Wilson | 52/704 |
| 3,896,599 | 7/1975 | Werstein et al. | 52/704 |
| 4,077,300 | 3/1978 | Yoda | 411/15 |
| 4,082,030 | 4/1978 | Erickson | 411/15 |
| 4,139,023 | 2/1979 | Turley | 138/96 T |
| 4,501,301 | 2/1985 | Snow, Sr. et al. | 138/96 T |
| 4,553,567 | 11/1985 | Telander | 138/96 T |

*Primary Examiner*—Neill R. Wilson
*Attorney, Agent, or Firm*—H. John Barnett

[57] ABSTRACT

A positioning system for accurately setting anchor bolts in concrete construction work. The anchor bolt is assembled in a formwork template with a threaded flange on the inner side of the template and a closed end sleeve having a flange covering the projecting outer, threaded end of the anchor bolt to firmly position the anchor bolt perpendicular to the concrete surface during pouring and setting of the concrete.

6 Claims, 1 Drawing Sheet

ANCHOR BOLT POSITIONING SYSTEM FOR CONCRETE FOUNDATIONS

BACKGROUND OF THE INVENTION

1. Field of the Invention

This invention relates to a positioning system for accurately setting anchor bolts in concrete casting of foundations. More particularly, the invention is directed to a threaded flange disposed on the anchor bolt next to the inner surface of a formwork template. The flange cooperates with a threaded, closed-end sleeve which has a flange on its inner end to firmly position the anchor bolt in a perpendicular relationship to the template inner surface during pouring and setting of the concrete to insure that the anchor bolt will extend outwardly at right angles to the concrete surface.

2. Description of Related Art

Devices for positioning anchor elements during concrete casting are described in U.S. Pat. Nos. 4,383,674 and 4,383,675. However, the core bodies disclosed in these patents are complex, and are primarily intended to form a recess in the concrete member to receive the eye portion of an anchor element used to haul the concrete member into position for concrete construction work. There is no critical need that the anchor bolt itself be perpendicular to the outer surface of the formed concrete body, and no mention is made of such purpose or intent.

U.S. Pat. No. 4,408,940 is directed to a bolt anchor assembly having a hollow tubular portion and a base plate. The anchor bolt is disposed inside the tubular member, and both the base plate and the tubular member remain embedded in the concrete after the anchor bolt is set. The main purpose of the sleeve, or tubular portion, is to provide allowance for lateral movement of the bolt to accommodate variations in location when anchoring heavy machinery to the concrete floor.

U.S. Pat. No. 4,781,006 describes a chord bar connector system for prefabricated concrete wall construction panels which are intended to be earthquake-proof. The casting system includes removable inserts to form notches for access to the chord bars to interconnect adjacent building panels. The chord bar connector is a positioning means for the chord bars, but it remains in the cast concrete panel.

An injection molded, internally threaded plastic cap or sleeve is shown in FIGS. 11.11, 11.12, and 11.13 of INJECTION MOULD DESIGN, authored by R.G.W. Pye, 2d Edition, Plastics & Rubber Institute, 1978. However, the cap or sleeve disclosed there has no perpendicular flange at its open end.

SUMMARY OF THE INVENTION

This invention provides an accurate and simple positioning system for an anchor bolt to be set in concrete. A suitable opening is provided in the forming template to receive an anchor bolt which is extended therethrough, and held in place at right angles to the inner surface of the template by the positioning system. A threaded plastic flange is disposed on the inner end of the threaded portion of the anchor bolt and the anchor bolt is positioned snugly against the template with the threaded end extending through the opening in it, and the threaded flange against the concrete-facing surface of the template. A threaded plastic sleeve is then threaded tightly down on the outer, threaded end of the anchor bolt to firmly hold it in position at right angles to the template surface.

The concrete foundation is then poured, with the template placed in position on the upper surface of the poured concrete with the anchor bolt extending down into the concrete mass at right angles to the upper surface of the formed concrete. After the concrete has set up, the template is removed by removing the outer, elongated plastic sleeve first, and then removing the template from the cured concrete. The threaded outer end of the anchor bolt is set at right angles to the concrete surface. The sleeve can then be replaced on the embedded anchor bolt as temporary protection until construction reaches the next stage.

Figure 1:
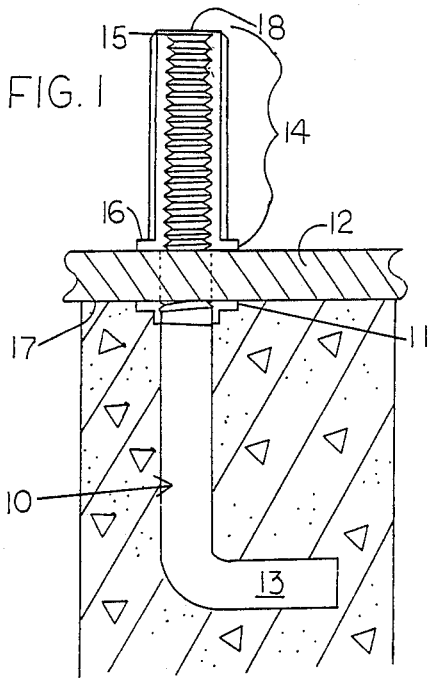
FIG. 1 of the drawings is a vertical, sectional view of the anchor bolt positioning system of the invention disposed in concrete during curing.
Figure 2:
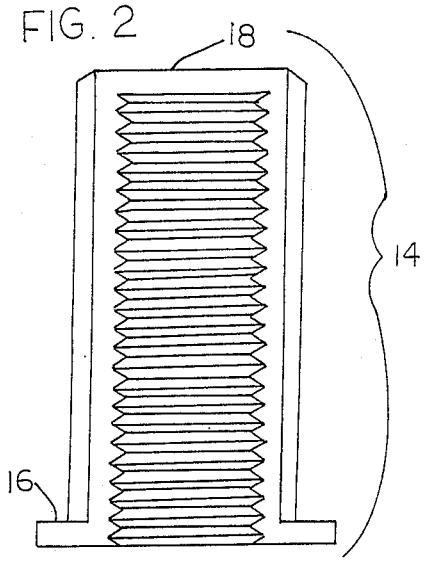
FIG. 2 is an enlarged, vertical sectional view of the threaded plastic sleeve, showing the inner, perpendicular flange portion.
Figure 4:
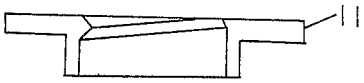
FIG. 4 is a side sectional view of the inner flange.
Figure 3:
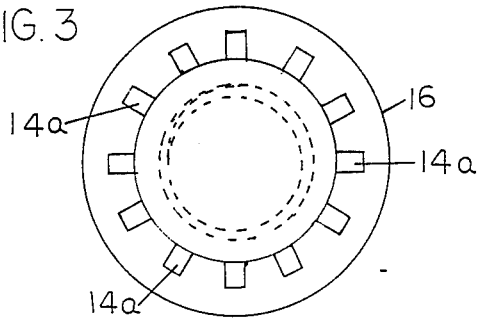
FIG. 3 is a top plan view of the threaded plastic sleeve looking down toward the inner, flanged end and showing the spacing of the reinforcing ribs and showing the internal threads in phantom.

As shown in the drawings, a threaded anchor bolt 10 has a threaded flange 11 disposed on the inner end of the threaded portion thereof in contact with the inner surface of a template 12. The inner end 13 of anchor bolt 10 is shown embedded in the freshly poured concrete. The threaded flange 11 cooperates with a threaded, plastic sleeve 14, which is threadably received on the outer, threaded end 15 of anchor bolt 10. The plastic sleeve 14 is also provided with reinforcing ribs **14*a*, and with a flange 16 at its inner end, which cooperates with the flange 11 to rest firmly against the opposite surfaces of the template 12, and to hold the anchor bolt 10 perpendicular to the surfaces of the template 12, thereby insuring that the outer threaded end 15 of the anchor bolt 10 will be positioned perpendicularly to formed concrete surface 17**.

In the present embodiment of the invention, the sleeve 14 has a closed outer end 18 so that it can be replaced on the threaded end 15 of the anchor bolt 10 after the concrete has set, and the template 12 has been removed. The sleeve 14 thus protects the otherwise exposed threaded end 15 of the anchor bolt 10 from the time the concrete has cured until the time that the next stage of construction begins, when the anchor bolts 10 are put in use. The threads are kept free of dirt, cement, and other debris common to construction sites so that the sleeves 14 can be removed, and the anchor bolts 10 immediately put in use without any delays for cleaning. Also, since the anchor bolts have been accurately positioned, the next stage of construction may proceed smoothly and efficiently, with no bending or breaking of any of the anchor bolts. The sleeves 14 are removed just before the anchor bolts are put into use, and the sleeves 14 can be used again and again in further construction work. The threaded flanges 11 remain embedded in the concrete surface 17, and new flanges 11 are used in the next assembly procedure.

Figure 6:
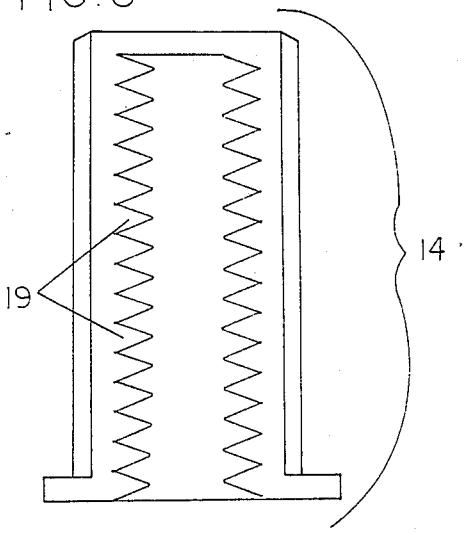
FIG. 6 is a side sectional view with parts broken away of another embodiment of the threaded plastic sleeve, but showing feather grippers replacing the threaded portion of the FIG. 2 embodiment.
Figure 5:
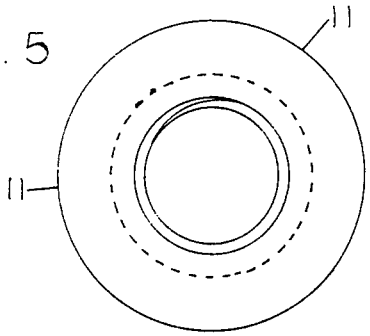
FIG. 5 is an end view of the inner flange, shown in FIG. 4, with the collar portion shown in phantom.

As shown in FIG. 6, the threaded portion of the threaded plastic sleeve 14 may instead be provided with feather grippers 19 to engage the threaded end 15 of the anchor bolt 10. The advantage of the grippers 19 is speed of assembly and removal of the threaded plastic sleeves 14 during construction work.

It is presently contemplated that threaded flanges 11 could be eliminated if the anchor bolts are provided with an integrally formed collar, or by tack welding a washer to the same relative portion of the anchor bolt. The sleeves 15 and the threaded flanges 11 are presently formed from plastic materials by injection molding, but either or both could be formed or cast from metal, or other suitable materials. The sleeves 14 are preferably brightly colored for easy visibility.

What is claimed is:

1. A positioning system for accurately setting an anchor bolt having an inner, anchor end, and an outer, threaded end, said inner, anchor end adapted to be embedded in a concrete foundation, comprising, in combination:

a re-usable, non-deformable, elongated, rigid sleeve having a closed first end and an open second end, said second end having an integral, rigid flange portion disposed perpendicularly and extending radially outwardly from the open end of said sleeve;

a concrete formwork template adapted to be disposed horizontally on the top surface of a newly poured concrete foundation, said template having an opening therethrough to receive the outer, threaded end of the anchor bolt;

a gripping means on the inner surface of said sleeve to grip the outer, threaded end of said anchor bolt extending vertically upward form the upper surface of said template; and a secondary positioning means adapted to be disposed on the lower, inner surface of the concrete formwork template on said anchor bolt, said elongated, rigid sleeve, said horizontally disposed template and said secondary positioning means cooperating to firmly position the outer, threaded end of the anchor bolt so that it extends vertically upward at right angles to the cured concrete surface, said rigid sleeve being capable of easy removal after curing of the concrete foundation to allow removal of the template, and said rigid sleeve being of a sufficient length so that it may be reinstalled over the exposed threaded end of said anchor bolt to completely cover and protect it until the anchor bolt is placed in use when said rigid sleeve is removed and may be re-used as set forth above.

2. The positioning system of claim 1, in which the gripping means inside the elongated sleeve comprises helical threads which are threadably received on the outer end of the anchor bolt.

3. The positioning system of claim 1, in which the gripping means inside the elongated sleeves comprises deformable protuberances which grip the threaded end of the anchor bolt.

4. The positioning means of claim 1 in which the elongated sleeve is plastic, and the gripping means comprises deformable plastic feather grippers.

5. The positioning system of claim 4, in which the elongated sleeve has a plurality of longitudinally extending ribs integrally formed in the outer peripheral surface thereof, said ribs reinforcing said sleeve and providing grip means for manually turning said sleeve on an anchor bolt.

6. In a positioning system for accurately setting anchor bolts in concrete, a re-usable, non-deformable elongated, rigid sleeve, having a first closed end, and a second open end for receiving the threaded outer end of an anchor bolt, an integral flanged portion disposed at the second open end of said sleeve and extending at right angles to the long axis of said sleeve, and a plurality of integral reinforcing ribs extending coaxial along the outside surface of said sleeve between the first and second ends thereof to reinforce the sleeve and provide manual gripping means for turning the sleeve on an anchor bolt, said sleeve having a substantially constant diameter and being adapted to be vertically disposed on the outer, upper surface of a concrete foundation template on the outer, threaded end of an anchor bolt, and further adapted to cooperate with an annular, threaded flange member also disposed on the threaded end of said anchor bolt, but just below the lower surface of the formwork template, said annular threaded flange member being firmly urged against the lower surface of the formwork template by tightening said rigid sleeve and said threaded flange member disposed on said anchor bolt outer thread end to urge the rigid sleeve and said flange against the formwork template to firmly hold said anchor bolt in an accurate vertical position while pouring and curing a concrete foundation.

* * * * *